US005636552A

United States Patent [19]

Richardson

[11] Patent Number: 5,636,552

[45] Date of Patent: Jun. 10, 1997

[54] SKID LOADER STEERING CONTROL LEVER EXTENSION

[76] Inventor: Stanley I. Richardson, R.R. #4, Box 170, Mifflintown, Pa. 17059-9157

[21] Appl. No.: 327,290

[22] Filed: Oct. 21, 1994

[51] Int. Cl.[6] ..... G05G 1/21

[52] U.S. Cl. ..... 74/544; 74/479.01; 180/320

[58] Field of Search ..... 74/544, 479.01, 74/494, 495, 480 B; 180/320, 321

[56] References Cited

U.S. PATENT DOCUMENTS

| | | | |
|---|---|---|---|
| 1,597,722 | 8/1926 | Clemons . | |
| 1,825,240 | 9/1931 | Miller | 74/480 B X |
| 1,862,186 | 6/1932 | Huddle . | |
| 2,309,159 | 1/1943 | Binger | 74/480 B |
| 2,527,801 | 10/1950 | Downing et al. | 74/480 |
| 2,543,553 | 2/1951 | McAllister | 74/480 B |
| 2,679,766 | 6/1954 | Jacobsen et al. | 74/480 B X |
| 2,705,444 | 4/1955 | McCormick | 97/46.01 |
| 2,745,506 | 5/1956 | McCallum | 180/77 |
| 2,747,425 | 5/1956 | Ohlau | 74/480 B |
| 2,915,915 | 12/1959 | McKay | 74/544 X |
| 3,003,363 | 10/1961 | Hart | 74/494 |
| 3,073,278 | 1/1963 | Brewster | 74/480 B X |
| 3,503,276 | 3/1970 | Vigot | 74/544 |
| 3,985,394 | 10/1976 | Rolfes | 302/34 |
| 4,369,856 | 1/1983 | Nudd | 180/321 |
| 4,516,655 | 5/1985 | Donahue et al. | 180/321 |
| 4,624,206 | 11/1986 | Frye et al. | 74/544 X |

*Primary Examiner*—Rodney H. Bonck
*Assistant Examiner*—Mary Ann Battista
*Attorney, Agent, or Firm*—Webb Ziesenheim Bruening Logsdon Orkin & Hanson P.C.

[57] ABSTRACT

A control lever extension includes a base plate and a receiving element pivotably connected to the base plate. A first end of a secondary control lever is configured to detachably engage the receiving element. A first end of an extension arm is pivotably connected to the secondary control lever and a receiving member for cooperation with the tractor controls is pivotably connected to a second end of the extension arm.

20 Claims, 2 Drawing Sheets

SKID LOADER STEERING CONTROL LEVER EXTENSION

BACKGROUND OF THE INVENTION

1. Field of the Invention

This invention relates generally to control lever extensions for construction vehicles and, more particularly, to steering control lever extensions for skid loader-type vehicles having a backhoe attachment.

2. Description of the Prior Art

A conventional skid loader has a cab which includes a driver's seat and a pair of steering control levers, one lever located on each side of the skid loader driver's seat. The driver moves and steers the skid loader by pushing or pulling on these steering control levers to move the skid loader in a forward or reverse direction or to turn the skid loader to the left or right.

Skid loader manufacturers manufacture backhoe attachments which can be attached to a skid loader to form a single skid loader/backhoe unit. The backhoe is generally attached to the skid loader forward of the skid loader cab and includes an elevated backhoe operating station having a backhoe operator's seat and a set of backhoe hand control levers. The backhoe includes a boom assembly that pivots around a horizontal pivot by means of a hydraulic ram. The outer end of the backhoe incorporates a bucket that is also pivotally supported about a horizontal pivot. The movements of the boom assembly and bucket are made possible by means of a hydraulic control system powered by the skid loader engine. Operation of the backhoe is controlled by the hand control levers located at the backhoe operating station.

A problem with these prior art skid loader/backhoe units is that the steering control levers in the skid loader cab cannot be operated from the backhoe operator's seat. Therefore, when the operator is seated at the backhoe operating station, he cannot move the skid loader/backhoe unit to reposition the backhoe. When the backhoe operator needs to reposition the backhoe by moving the skid loader, he must get off the backhoe operator's seat, climb into the skid loader cab, sit in the skid loader driver's seat and then operate the steering control levers to move the skid loader/backhoe unit. One problem with this arrangement is that it wastes valuable operating time caused by forcing the operator to travel back and forth between the backhoe operator's seat and skid loader driver's seat numerous times during the course of an average job simply to reposition the skid loader/backhoe unit. Another problem is that since the backhoe is located in front of the cab of the skid loader, visibility from the skid loader driver's seat is obstructed and many attempts may be necessary to correctly position the skid loader/backhoe unit so that the backhoe can be most effectively used.

What is needed is a device for remote operation of the skid loader steering control levers from the backhoe operating station. While remote lever operating devices are generally known in the art, these prior art devices are not designed for, nor could they be easily adapted for use with, a skid loader/backhoe unit as described above.

U.S. Pat. No. 2,527,801 to Downing et al. discloses an extension member for a tractor gear shift lever which permits operation of the gear shift lever from a remote location. The extension member is bracketed at one end to the gear shift lever and is also bracketed to a support which is required to be mounted on the tractor. U.S. Pat. No. 4,369,856 to Nudd discloses a mechanism for controlling engine speed of a tractor for operation of a rear mounted backhoe. The mechanism includes a complex series of brackets, flanges and plates which translate rotational movement of a hand throttle to translational movement of a fuel pump throttle lever. Additional extension control devices are disclosed in U.S. Pat. Nos. 1,597,722; 1,862,186; and 2,705,444. In each of these devices, a complicated series of levers is used to control operation of some aspect of a piece of equipment. These devices are generally complex to fabricate and generally require the installation of permanently mounted support members. Furthermore, the devices are generally difficult to install and even more difficult to remove when they are no longer required for operation of the equipment.

Therefore, it is an object of the present invention to provide a lightweight, easily installed control lever extension for skid loader-type steering control levers.

A further object of the present invention is to provide a control lever extension which can be easily removed and stored.

SUMMARY OF THE INVENTION

A control lever extension of the present invention includes a base plate and a receiving element pivotably connected to the base plate. A first end of a secondary control lever is configured to detachably engage the receiving element. A first end of an extension arm is pivotably connected to the secondary control lever and a receiving member for cooperation with the tractor controls is pivotably connected to a second end of the extension arm.

DESCRIPTION OF THE PREFERRED EMBODIMENT

Figure 1:
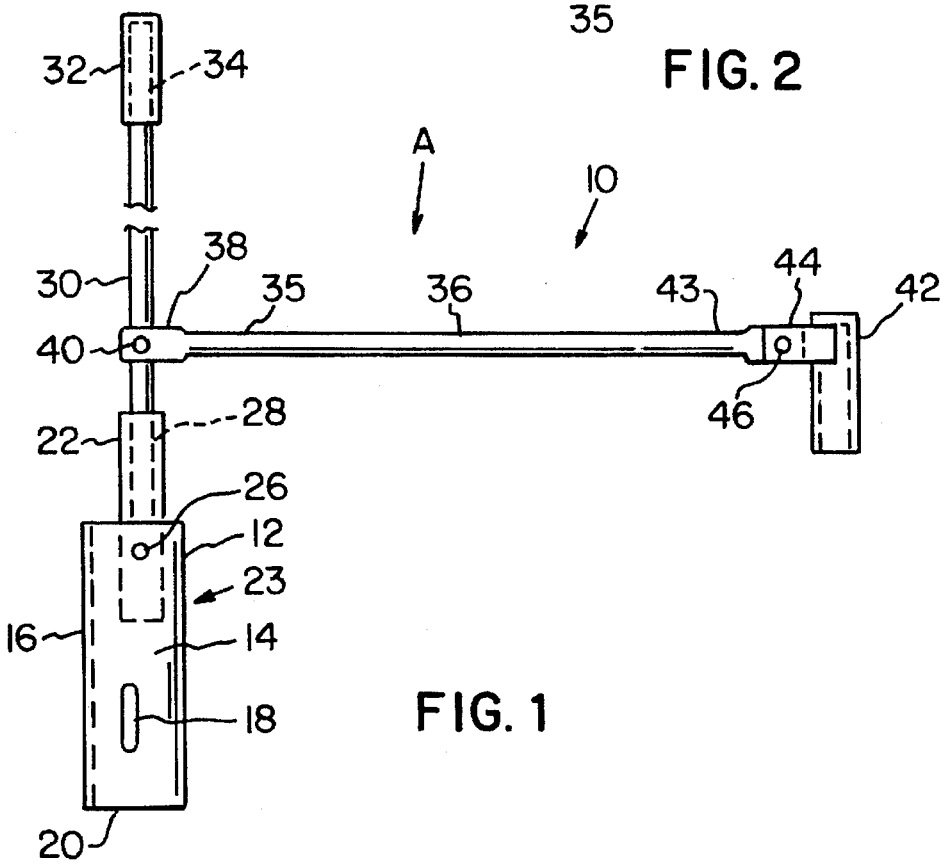
FIG. 1 is a broken side elevation of a control lever extension of the present invention.
Figure 3:
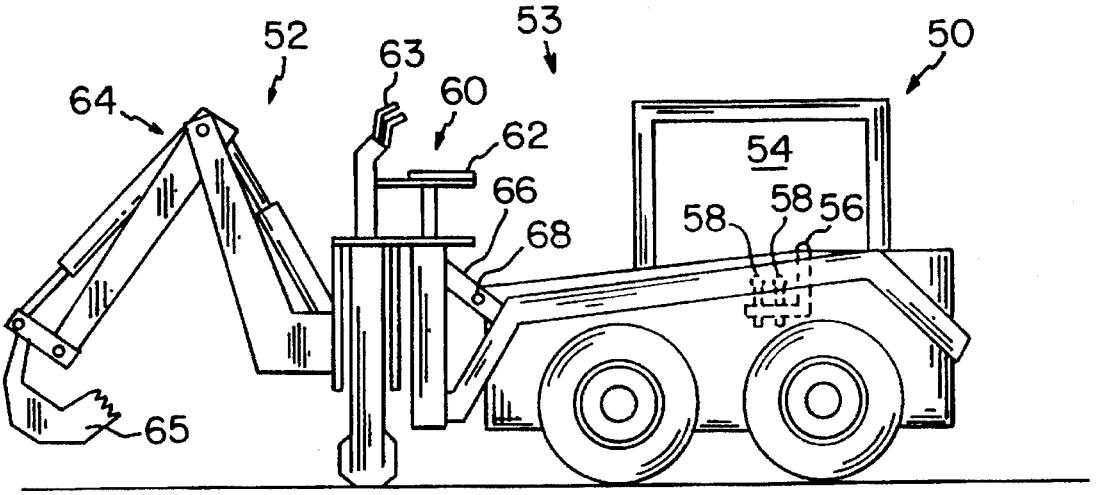
FIG. 3 is a side elevation of a skid loader/backhoe unit.
Figure 4:
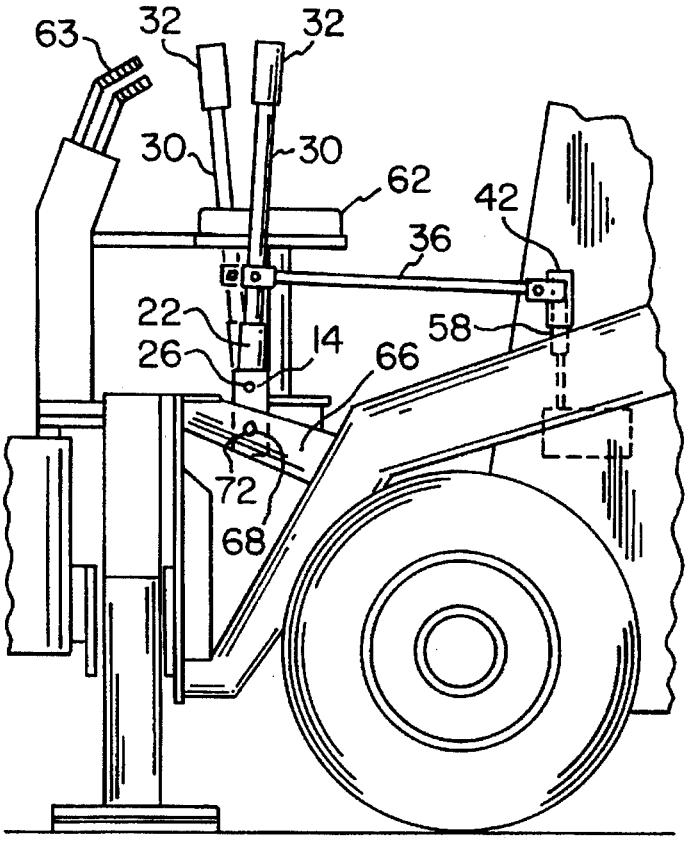
FIG. 4 is a broken front elevation of the control lever extension of FIG. 1 installed on the skid loader/backhoe unit of FIG. 3.
Figure 5:
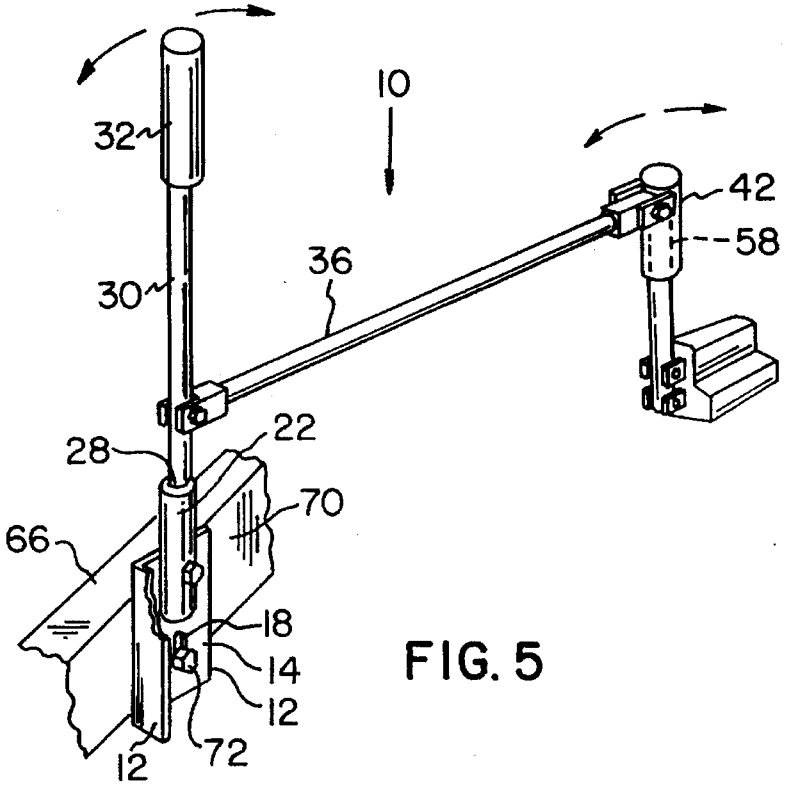
FIG. 5 is an enlarged, perspective view of the control lever extension of FIG. 4.

A steering control lever extension of the present invention is generally designated 10 in FIGS. 1–5 of the drawings. Control lever extension 10 is preferably made of a corrosion resistant metal, such as stainless steel or aluminum. As shown in FIGS. 1 and 5, the control lever extension 10 includes an L-shaped base plate 12 having substantially perpendicular, rectangular panels 14 and 16. Base plate 12 is L-shaped to provide lateral strength to help prevent bending and flexing of base plate 12 during operation of control lever extension 10. An elongated adjustment slot 18 is disposed on panel 14 of base plate 12 near a bottom end 20 thereof. Slot 18 extends substantially perpendicular to bottom end 20 of base plate 12.

A hollow, cylindrical receiving element 22 is pivotably mounted to rectangular panel 14 of base plate 12 by a pivot bolt 26. Pivot bolt 26 passes through a bore in panel 14 aligned with another bore in a lower end of receiving element 22 and allows receiving element 22 to pivot in a plane parallel to the plane containing panel 14 of base plate 12. Receiving element 22 is configured to detachably receive a first end 28 of a secondary control lever 30 as shown in FIG. 1. The inside diameter of receiving element 22 is slightly larger than the exterior diameter of first end 28 of secondary control lever 30 so that secondary control lever 30 can be easily inserted into and removed from receiving element 22. Secondary control lever 30 is preferably a hollow, corrosion resistant, cylindrical metal rod. A handle grip 32 is carried on a second end 34 of secondary control lever 30 opposite first end 28.

One end 35 of an extension arm 36 is pivotably connected to secondary control lever 30 between handle grip 32 and first end 28. Extension arm 36 is preferably a hollow, corrosion resistant, cylindrical metal rod having a yoke assembly 38 carried on end 35. Yoke assembly 38 has a bore passing therethrough. End 35 of extension arm 36 is pivotably connected to secondary control lever 30 by a pivot bolt 40 passing through a bore in secondary control lever 30 aligned with the bore in yoke assembly 38.

Figure 2:
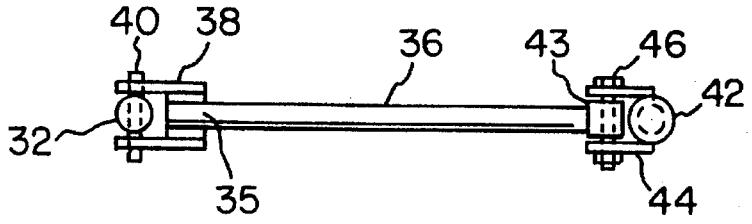
FIG. 2 is a plan view of the control lever extension as seen in the direction of arrow A of FIG. 1.

A hollow, cylindrical handle receiving member 42 is attached to the other end 43 of extension arm 36. Receiving member 42 includes a yoke assembly 44 attached to an exterior wall thereof. Yoke assembly 44 includes a bore passing therethrough and surrounds a portion of end 43 of extension arm 36. Receiving member 42 is pivotably connected to end 43 of extension arm 36 by a pivot bolt 46 passing through the bore in yoke assembly 44 aligned with the bore in end 43 of extension arm 36, as shown in FIG. 2.

FIG. 3 shows a skid loader 50 having an attached backhoe 52 to form a skid loader/backhoe unit 53. Skid loader 50 includes a cab portion 54 having a skid loader driver's seat 56 and a pair of steering control levers 58, one steering lever 58 located on each side of skid loader driver's seat 56. Backhoe 52 includes a backhoe operator's station 60 having a backhoe operator's seat 62 and a set of hand control levers 63 for operating backhoe 52 by controlling the movements of a boom assembly 64 having a bucket 65 mounted at an outer end thereof. Skid loader 50 includes support elements 66 located on each side of skid loader 50 between skid loader 50 and backhoe 52. In some skid loader models, for example John Deere Model 675B, pre-drilled bolt holes 68 are present in support elements 66.

As shown in FIGS. 4 and 5, to attach control lever extension 10 to skid loader 50, panel 14 of base plate 12 is placed against an interior side 70 of support element 66 such that bolt hole 68 aligns with elongated slot 18, with receiving element 22 uppermost. A holding bolt 72 is passed through bolt hole 68 and elongated slot 18 and is then tightened to securely hold base plate 12 to support element 66.

First end 28 of secondary control lever 30 is then inserted into the top of receiving element 22 and receiving member 42 is placed over the top of the associated steering control lever 58. This procedure is then repeated on the other side of skid loader 50 so that one secondary control lever 30, attached to an associated steering control lever 58, is located on each side of backhoe operator's seat 62 within easy reach of a backhoe operator as shown in FIG. 4. The height of secondary control lever 30 with respect to backhoe operator's seat 62 can be adjusted by loosening holding bolt 72, vertically sliding base plate 12 along elongated adjustment slot 18 to a desired new position and then retightening holding bolt 72.

Further, when the job at hand is completed and backhoe 52 is no longer needed, secondary control lever 30, including attached extension arm 36 and receiving member 42, can be easily removed by withdrawing first end 28 of secondary control lever 30 from receiving element 22 and removing receiving member 42 from steering lever 58. Base plate 12 with attached receiving element 22 can be quickly unbolted and removed or can be left in place on support element 66 without unduly interfering with operation of skid loader 50.

Use of control lever extension 10 with skid loader/backhoe unit 53 is as follows. When the backhoe operator sitting in backhoe operator's seat 62 needs to reposition skid loader/backhoe unit 53, the backhoe operator simply grasps handle grips 32 on secondary control levers 30 and operates secondary control levers 30 as he would steering control levers 58. Movement of a secondary control lever 30 is directly translated to a similar movement of an associated steering control lever 58. Thus, the operator does not have to climb back into cab portion 54 of skid loader 50 each time skid loader/backhoe unit 53 needs to be repositioned.

Valuable time is saved by no longer requiring the backhoe operator to make frequent trips between backhoe operator's seat 62 and skid loader driver's seat 56 to reposition the skid loader/backhoe unit 53. Further, since backhoe operator's seat 62 is above skid loader driver's seat 56 and therefore has a superior field of vision, more accurate positioning of backhoe 52 with respect to the job at hand is possible.

While a preferred embodiment of the invention has been described in detail herein, it will be appreciated by those skilled in the art that various modifications and alternatives to the embodiment could be developed in light of the overall teachings of the disclosure. Accordingly, the particular arrangement is illustrative only and is not limiting as to the scope of the invention which is to be given the full breadth of the appended claims and any and all equivalents thereof.

I claim:

1. A control lever extension for remote operation of a steering control lever of a skid loader vehicle, said control lever extension comprising:

a hollow receiving element adapted to be pivotably connected to the vehicle, wherein said hollow receiving element has an inside diameter;

a secondary control lever having a first end and a second end, wherein said first end of said secondary control lever has an exterior diameter, wherein said inside diameter of said receiving element is larger than said exterior diameter of said first end of said secondary control lever such that said first end of said secondary control lever is configured to be detachably inserted into said hollow receiving element;

an extension arm having a first end and a second end, with said first end of said extension arm pivotably connected to said secondary control lever intermediate said first and second ends of said secondary control lever; and a hollow receiving member pivotably connected to said second end of said extension arm, wherein said hollow receiving member has an inside diameter, wherein said inside diameter of said receiving member is larger than an exterior diameter of the steering control lever such that said hollow receiving member is configured to detachably receive the steering control lever of the vehicle, whereby said secondary control lever, said extension arm and said hollow receiving member are adapted to be detachable as a unit from the vehicle.

2. A control lever extension as claimed in claim 1, wherein said control lever extension is comprised of a corrosion resistant metal.

3. A control lever extension as claimed in claim 1, wherein said hollow receiving element has a sidewall, with a bore passing through said sidewall and wherein said hollow receiving element is adapted to be attached to the vehicle by a pivot bolt passing through said bore.

4. A control lever extension as claimed in claim 1, wherein said first end of said extension arm is connected to said secondary control lever by a yoke assembly.

5. A control lever extension as claimed in claim 1, wherein said second end of said extension arm is connected to said hollow receiving member by a yoke assembly.

6. A control lever extension as claimed in claim 1, further including a handle grip carried on said second end of said secondary control lever.

7. A control lever extension as claimed in claim 1, wherein said hollow receiving element is a cylindrical receiving element and wherein said first end of said secondary control lever has an exterior diameter less than an inside diameter of said cylindrical receiving element whereby said first end of said secondary control lever is configured to detachably engage said cylindrical receiving element.

8. A control lever extension as claimed in claim 1, further including a base plate, wherein said hollow receiving element is pivotably connected to said base plate.

9. A control lever extension as claimed in claim 2, wherein said base plate includes an elongated adjustment slot disposed therein.

10. A control lever extension for remote operation of a steering control lever of a skid loader vehicle, said control lever extension comprising:

a base plate;

a hollow receiving element pivotably connected to said base plate, wherein said hollow receiving element has an inside diameter;

a secondary control lever having a first end and a second end, wherein said first end of said secondary control lever has an exterior diameter, wherein said inside diameter of said receiving element is larger than said exterior diameter of said first end of said secondary control lever such that said first end of said secondary control lever is configured to be detachably inserted into said hollow receiving element;

an extension arm.having a first end and a second end, with said first end of said extension arm pivotably connected to said secondary control lever intermediate said first and second ends of said secondary control lever; and a hollow receiving member pivotably connected to said second end of said extension arm, wherein said hollow receiving member has an inside diameter, wherein said inside diameter of said receiving member is larger than an exterior diameter of the steering control lever such that said hollow receiving member is configured to detachably receive the steering control lever of the vehicle, whereby said secondary control lever, said extension arm and said hollow receiving member are adapted to be detachable as a unit from the vehicle.

11. A control lever extension as claimed in claim 10, further including a handle grip carried on said second end of said secondary control lever.

12. A control lever extension as claimed in claim 10, wherein said base plate includes two substantially perpendicular, substantially rectangular panels.

13. A control lever extension as claimed in claim 10, wherein said hollow receiving element is a cylindrical element having a sidewall, with a bore passing through said sidewall and wherein said cylindrical element is attached to said base plate by a pivot bolt passing through said bore.

14. A control lever extension as claimed in claim 10, wherein said first end of said extension arm includes a yoke assembly.

15. A control lever extension as claimed in claim 10, wherein said first end of said extension arm is connected to said secondary control lever by a pivot bolt.

16. A control lever extension as claimed in claim 10, wherein said hollow receiving member includes a sidewall and wherein a yoke assembly is disposed on said sidewall.

17. A control lever extension as claimed in claim 10, wherein said hollow receiving member is pivotably connected to said second end of said extension arm by a pivot bolt.

18. A control lever extension as claimed in claim 10, wherein said control lever extension is comprised of a corrosion resistant metal.

19. A control lever extension as claimed in claim 10, wherein said base plate further includes an elongated adjustment slot disposed therein.

20. A control lever extension for remote operation of a steering control lever of a skid loader vehicle, said control lever extension comprising:

a base plate, said base plate including two substantially perpendicular, substantially rectangular panels, with an elongated adjustment slot disposed in one of said panels;

a receiving element pivotably attached to said base plate, wherein said receiving element is a hollow, cylindrical receiving element having an inside diameter and a sidewall, with a bore passing through said receiving element sidewall, and wherein said receiving element is attached to said base plate by a pivot bolt passing through said bore;

a secondary control lever having a first end and a second end, wherein said first end of said secondary control lever has an exterior diameter less than the inside diameter of said receiving element whereby said first end of said secondary control lever is configured to be detachably inserted into said receiving element;

a handle grip carried on said second end of said secondary control lever;

an extension arm having a first end and a second end, with said first end of said extension arm having a yoke assembly carried thereon and wherein said first end of said extension arm is pivotably attached to said secondary control lever intermediate said first and second ends of said secondary control lever by a pivot bolt passing through said yoke assembly and said secondary control lever; and a hollow receiving member pivotably connected to said second end of said extension arm, wherein said hollow receiving member has an inside diameter, wherein said inside diameter of said receiving member is larger than an exterior diameter of the steering control lever such that said hollow receiving member is configured to detachably receive the steering control lever, wherein said receiving member has a sidewall, wherein a yoke assembly is disposed on said sidewall, and wherein said receiving member is pivotably connected to said second end of said extension arm by a pivot bolt passing through said receiving member yoke assembly and said second end of said extension arm, whereby said first end of said secondary control lever is configured to be detachably inserted into said hollow receiving element such that said secondary control lever, said extension arm and said hollow receiving member are adapted to be detachable as a unit from the vehicle.

* * * * *